US011066715B2

(12) United States Patent
Shimizu et al.

(10) Patent No.: US 11,066,715 B2
(45) Date of Patent: Jul. 20, 2021

(54) DEHYDROGENATION PROCESSING METHOD FOR TURBINE BLADES

(71) Applicant: Mitsubishi Hitachi Power Systems, Ltd., Kanagawa (JP)

(72) Inventors: Yuichi Shimizu, Tokyo (JP); Tatsuya Furukawa, Kanagawa (JP); Ryuichi Matsubara, Tokyo (JP); Kenji Sato, Tokyo (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 342 days.

(21) Appl. No.: 16/086,705

(22) PCT Filed: Mar. 6, 2017

(86) PCT No.: PCT/JP2017/008808
§ 371 (c)(1),
(2) Date: Sep. 20, 2018

(87) PCT Pub. No.: WO2017/169537
PCT Pub. Date: Oct. 5, 2017

(65) Prior Publication Data

US 2019/0100817 A1 Apr. 4, 2019

(30) Foreign Application Priority Data

Mar. 31, 2016 (JP) ..... JP2016-071719

(51) Int. Cl.
*C21D 3/06* (2006.01)
*C21D 9/00* (2006.01)
(Continued)

(52) U.S. Cl.
CPC ..... *C21D 3/06* (2013.01); *C21D 1/34* (2013.01); *C21D 9/00* (2013.01); *F01D 5/12* (2013.01);
(Continued)

(58) Field of Classification Search
CPC ..... C21D 3/06; F01D 9/02
(Continued)

(56) References Cited

U.S. PATENT DOCUMENTS 8,863,521 B2 10/2014 Goto et al.
2017/0306801 A1 10/2017 Beul et al.

FOREIGN PATENT DOCUMENTS

DE 102014221563 4/2016
JP 53-92009 8/1978
(Continued)

OTHER PUBLICATIONS

Translation JP-1990308903 (Year: 1990).*
(Continued)

*Primary Examiner* — Coris Fung
*Assistant Examiner* — Danielle Carda
(74) *Attorney, Agent, or Firm* — Wenderoth, Lind & Ponack, L.L.P.

(57) ABSTRACT

A dehydrogenation processing method for a turbine blade of a steam turbine. The method includes a step of heating the turbine blade by suppling heating steam into a casing of the steam turbine after a steam turbine plant is stopped. The heating steam supplied to the casing has a temperature that is higher than steam passing through the turbine blade during operation of the steam turbine plant. The method further includes repeating the process of supplying the heating steam into the casing a multiple of times.

11 Claims, 6 Drawing Sheets

(51) Int. Cl.

| | |
|---|---|
| ***F01D 25/10*** | (2006.01) |
| ***F01D 9/02*** | (2006.01) |
| ***F01K 21/06*** | (2006.01) |
| ***F01K 13/02*** | (2006.01) |
| ***F01D 25/00*** | (2006.01) |
| ***C21D 1/34*** | (2006.01) |
| ***F01D 5/12*** | (2006.01) |

(52) U.S. Cl.
CPC ..... *F01D 9/02* (2013.01); *F01D 25/00* (2013.01); *F01D 25/10* (2013.01); *F01K 13/02* (2013.01); *F01K 21/06* (2013.01); *C21D 2211/008* (2013.01); *F05D 2230/40* (2013.01); *F05D 2240/30* (2013.01); *F05D 2300/171* (2013.01); *F05D 2300/701* (2013.01)

(58) Field of Classification Search
USPC ..... 148/655
See application file for complete search history.

(56) References Cited

FOREIGN PATENT DOCUMENTS

| | | | |
|---|---|---|---|
| JP | 62-159704 | | 7/1987 |
| JP | 2-308903 | | 12/1990 |
| JP | 1990308903 | * | 12/1990 |
| JP | 6-306550 | | 11/1994 |
| JP | 6-306551 | | 11/1994 |
| JP | 8-121112 | | 5/1996 |
| JP | 9-87739 | | 3/1997 |
| JP | 2010159713 A | * | 7/2010 |
| JP | 5479192 | | 4/2014 |
| KR | 10-1588145 | | 1/2016 |

OTHER PUBLICATIONS

Translation JP-2010159713-A (Year: 2010).*
Chauhan, Function of Gland Steaming in Turbine Operation (Year: 2016).*
D. Saidi et al. Microstructure and fracture mode of a martensitic stainless steel steam turbine blade characterized via scanning auger microscopy and potentiodynamic polarization (Year: 2014).*
International Search Report dated May 16, 2017 in International (PCT) Application No. PCT/JP2017/008808, with English translation.
International Preliminary Report on Patentability dated Oct. 11, 2018 in International (PCT) Application No. PCT/JP2017/008808, with English translation.
Korean Office Action dated Oct. 22, 2019 in corresponding Korean Patent Application No. 10-2018-7027445 with Machine translation.
Examination Report dated Dec. 16, 2019 in corresponding India Patent Application No. 201817033814.
Office Action dated Oct. 8, 2020 in corresponding German Patent Application No. 11 2017 001 657.6.

* cited by examiner

DEHYDROGENATION PROCESSING METHOD FOR TURBINE BLADES

TECHNICAL FIELD

The present disclosure relates to a dehydrogenation processing method for turbine blades of a steam turbine.

BACKGROUND ART

Typically, steel is used for turbine blades of a steam turbine. For instance, Patent Document 1 discloses a turbine blade using martensitic stainless steel.

In such turbine blades, there is a risk of occlusion of hydrogen in the steel depending on the processing procedure. If steel to be used as turbine blades occludes hydrogen, the turbine blades may become brittle due to the effect of hydrogen.

CITATION LIST

Patent Literature

Patent Document 1: JPH6-306550A

SUMMARY

Problems to be Solved

Meanwhile, as a general dehydrogenation processing method for steel, known is baking, where steel is heated to release occluded hydrogen.

However, in a case where large turbine blades near a final stage of a steam turbine go through a thermal process, it is necessary to provide a large thermal processing device, and a considerable amount of time is required to complete the thermal processing, for only a limited number of turbine blades can be processed at a time.

Thus, required is a method whereby it is possible to suppress hydrogen embrittlement of turbine blades, without performing complicated works.

An object of at least some embodiments of the present invention is to provide a dehydrogenation processing method for turbine blades whereby it is possible to suppress hydrogen embrittlement of turbine blades, without performing laborious works.

Solution to the Problems (1) According to at least some embodiments of the present invention, a dehydrogenation processing method for a turbine blade of a steam turbine includes: a step of heating the turbine blade by supplying heating steam into a casing of the steam turbine when a steam turbine plant is started or stopped.

During operation of a steam turbine plant, the steam temperature at each position inside the casing is substantially fixed. Thus, depending on position inside the casing, steam having a relatively low temperature acts on the turbine blades, and release of hydrogen from the turbine blades can be barely expected during operation of the steam turbine plant.

According to the above method (1), heating steam is supplied into the casing when the steam turbine plant is started or stopped, and thus it is possible to use heating steam having a suitable temperature for dehydrogenation processing, unlike when the steam plant is in operation.

Thus, also for the turbine blades that hardly release hydrogen during operation of the steam turbine plant, it is possible to perform the dehydrogenation processing, by causing the turbine blades to make contact with heating steam when the steam turbine plant is started or stopped.

Accordingly, it is possible to suppress hydrogen embrittlement of the turbine blades, without performing complicated works such as removing the turbine blades.

(2) In some embodiments, in the above method (1), the heating steam has a higher temperature than steam passing through the turbine blade during operation of the steam turbine (working steam).

Further, by using heating steam having a higher temperature than working steam that passes through the turbine blades to be dehydrogenated (to be heated) during operation of the steam turbine plant (i.e. working steam temperature at the position of the turbine blades to be dehydrogenated), it is possible to raise the temperature of the turbine blades more easily, and thus promote dehydrogenation of the turbine blades.

Herein, in a case where a plurality of stages of turbine blades are provided in the casing, one or more stages of turbine blades including the final stage (lowest-pressure stage) may be set as the turbine blades to be dehydrogenated (to be heated), and the temperature of the heating steam may be set to be higher than the working steam temperature at the position of the turbine blades of the stage to be heated. In this case, the heating steam temperature may be lower than the temperature of working steam passing through stages upstream of the stages to be heated.

(3) In some embodiments, in the above method (1) or (2), the step of heating the turbine blade includes supplying gland steam as the heating steam into the casing via a gland seal portion of the steam turbine.

In a typical steam turbine, gland seal portions are supplied with gland steam, to suppress leakage of steam from the casing interior space to the casing exterior via a gap between the casing and the rotor, or entry of air from the casing exterior to the casing interior space.

According to the above method (3), by utilizing the gland seal portions and the gland steam system, which are provided for a typical steam turbine facility, it is possible to introduce gland steam (heating steam) into the casing readily via the gland seal portions, when the steam turbine plant is started or stopped and the pressure of the casing decreases. Thus, it is possible to perform the dehydrogenation processing for the turbine blades without providing special equipment to supply heating steam into the casing.

(4) In some embodiments, in the above method (3), the step of heating the turbine blade includes setting the temperature of the gland steam to be higher than gland steam during operation of the steam turbine.

According to the above method (4), by setting the temperature of gland steam to be higher than that in operation of the steam turbine, it is possible to heat the turbine blades to an even higher temperature, and thereby to perform the dehydrogenation processing for the turbine blades effectively.

(5) In some embodiments, in the above method (3) or (4), the temperature of the gland steam is adjusted by a temperature adjuster disposed in a gland steam line for supplying the gland steam to the gland seal portion.

According to the above method (5), by adjusting the temperature of gland steam to be supplied to the gland seal portion with the temperature adjuster disposed in the gland steam line, it is possible to control the temperature of the turbine blades in the dehydrogenation processing, and perform dehydrogenation processing effectively. Furthermore, it is possible to suppress an excessive increase in the temperature of the gland steam, and prevent operation of the interlock related to the gland steam temperature, for instance.

(6) In some embodiments, in the above method (5), the temperature adjuster is a desuperheater disposed in the gland steam line between a gland steam header and the gland seal portion, and the desuperheater is configured to adjust a temperature decrease amount of the gland steam.

According to the above method (6), it is possible to adjust the temperature of gland steam flowing toward the gland seal portion from the gland steam header appropriately with the desuperheater, and thereby it is possible to promote dehydrogenation processing and prevent operation of interlock related to the gland steam temperature at the same time.

(7) In some embodiments, in the above method (6), the step of heating the turbine blade includes increasing a temperature setting value of the gland steam at the desuperheater compared to during operation of the steam turbine.

According to the above method (7), by setting the temperature setting value of gland steam at the desuperheater to be higher than that in operation of the steam turbine, it is possible to heat the turbine blades to an even higher temperature, and thereby to perform the dehydrogenation processing effectively.

(8) In some embodiments, in any one of the above methods (3) to (7), the method further includes: introducing the gland steam into the casing by supplying the gland steam into the gland seal portion while maintaining a pressure inside the casing to be less than an atmospheric pressure; and, after heating the turbine blade, increasing the pressure inside the casing to the atmospheric pressure, or stopping supply of the gland steam to the gland seal portion.

According to the above method (8), it is possible to introduce gland steam easily into the casing by supplying gland steam to the gland seal portions while maintaining the pressure in the casing to be less than the atmospheric pressure. Thus, it is possible to fill the casing with high-temperature gland steam, and heat the turbine blades effectively with the gland steam.

(9) In some embodiments, in any one of the above methods (1) to (8), the step of heating the turbine blade includes heating the turbine blade to a temperature of 120° C. or higher.

As a result of intensive researches by the present inventors, it was found that the hydrogen content in the turbine blades decreases significantly by heating the turbine blades to a temperature of 120° C. or higher.

Thus, according to the above method (9), it is possible to perform dehydrogenation processing on the turbine blades effectively by increasing the temperature of the turbine blades to 120° C. or higher.

(10) In some embodiments, in any one of the above methods (1) to (9), the method further comprises repeating a process of supplying the heating steam into the casing for multiple times.

As a result of intensive researches by the present inventors, it was found that the hydrogen content in the turbine blades decreases considerably by repeating the heating process for the turbine blades multiple times.

According to the above method (10), it is possible to perform the dehydrogenation processing on the turbine blades effectively by repeating the heating process for the turbine blades multiple times.

(11) In some embodiments, in the above method (10), the method further includes repeating the process of supplying the heating steam into the casing for multiple times when the steam turbine plant is started or stopped, until an accumulated execution number of the process reaches a predetermined number.

According to the above method (11), it is possible to perform the dehydrogenation processing for the turbine blades effectively, by repeating the heating process for the turbine blades until the accumulation execution number of the heating process reaches a predetermined number.

Herein, "predetermined number" is typically two or more, and may be set individually depending on the type of the steam turbine, the gland steam temperature, and the like.

(12) In some embodiments, in any one of the above methods (1) to (11), the turbine blade to be heated includes a final stage blade of a low-pressure steam turbine.

During operation of the steam turbine, steam having a low temperature such as about 50° C. acts on the final stage blades of the low-pressure steam turbine. Thus, release of hydrogen from the turbine blades can be barely expected during operation of the steam turbine.

In this regard, according to the above method (12), as described in the above (1), it is possible to suppress hydrogen embrittlement of the final stage blades of the low-pressure turbine, without performing complicated works such as removing the turbine blades, by supplying heating steam into the casing when the steam turbine plant is started or stopped.

(13) In some embodiments, in any one of the above methods (1) to (12), the turbine blade is made of martensitic stainless steel.

According to findings of the present inventors, martensitic stainless steel used to make the turbine blades tends to become brittle when the hydrogen content increases.

In this regard, according to the above method (13), as described in the above (1), it is possible to prevent damage due to hydrogen embrittlement of the turbine blades made of martensitic stainless steel, without performing complicated works such as removing the turbine blades, by supplying heating steam into the casing when the steam turbine plant is started or stopped.

Advantageous Effects

According to at least some embodiments of the present invention, also for the turbine blades that hardly release hydrogen during operation of the steam turbine plant, it is possible to perform dehydrogenation processing, by causing the turbine blades to make contact with heating steam when the steam turbine plant is started or stopped. Accordingly, it is possible to suppress hydrogen embrittlement of the turbine blades, without performing complicated works such as removing the turbine blades.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

Figure 1:
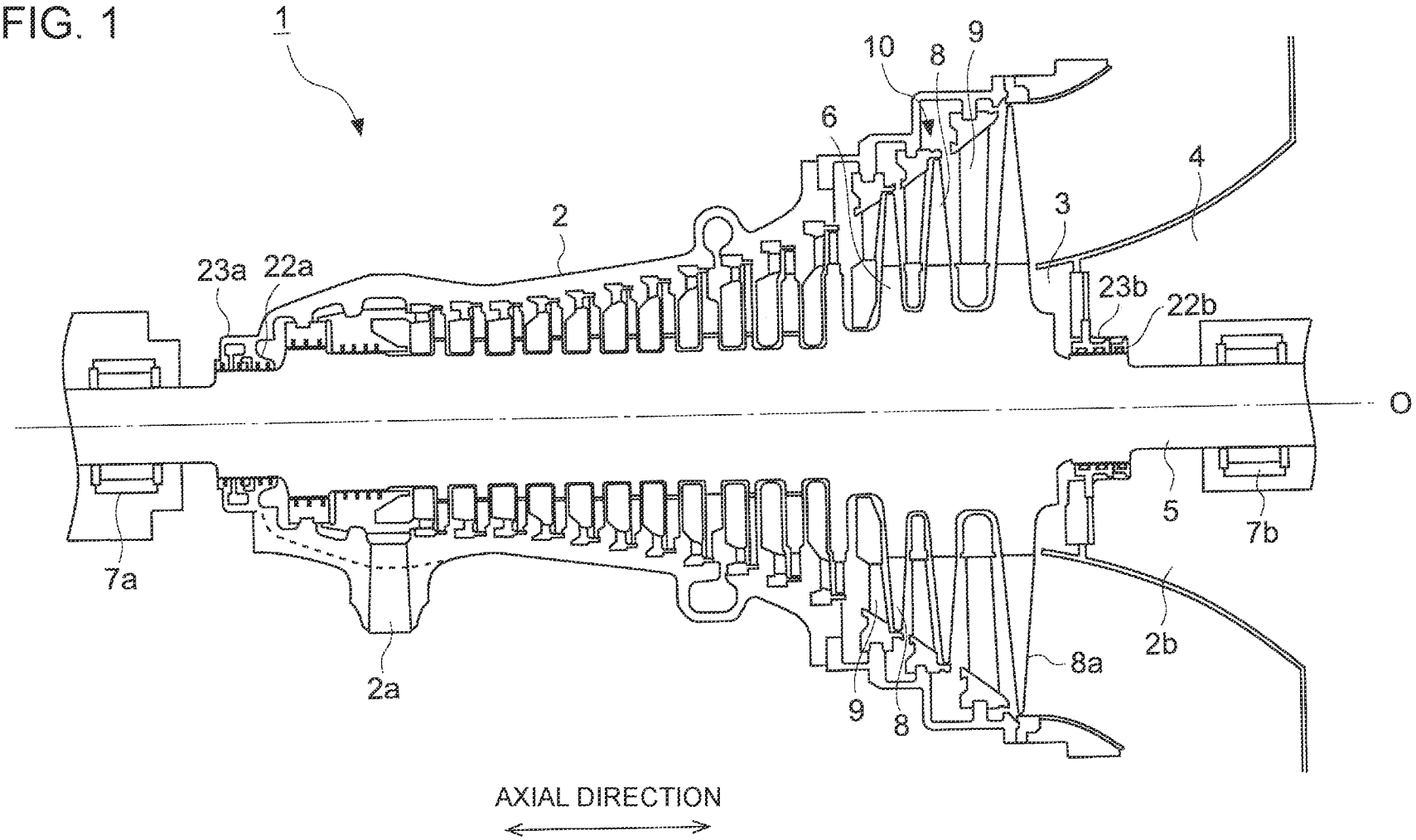
FIG. 1 is a cross-sectional view of a steam turbine according to an embodiment.

First, with reference to FIG. 1, a schematic configuration of a steam turbine 1 will be described as an example of application of the dehydrogenation processing method for turbine blades according to the present embodiment. Herein, FIG. 1 is a cross-sectional view of a steam turbine 1 according to an embodiment. The steam turbine 1 is provided for a plant such as a thermal power generation plant, for instance.

In some embodiments, the steam turbine 1 includes a casing 2, a rotor 5 disposed so as to penetrate through the casing 2, turbine blades 10 including a plurality of rotor blades 8 and a plurality of stationary vanes 9, and gland seal portions 22*a*, 22*b* for suppressing leakage of steam from a casing interior space 3.

The casing 2 includes a casing inlet 2*a* disposed on the first side in the axial direction of the rotor 5, for introducing steam into the casing 2, and a casing outlet 2*b* disposed on the second side, for discharging steam after having performed work.

The rotor 5 is supported by bearings 7*a*, 7*b* so as to be rotatable about the axis O.

The plurality of rotor blades 8 are mounted to the rotor 5 via a turbine disc 6, so as to be arranged in the circumferential direction of the rotor 5. The plurality of rotor blades 8 are disposed in a plurality of stages in the axial direction of the rotor 5, thereby forming rotor blade rows.

The plurality of stationary vanes 9 are mounted to the inner surface of the casing 2, so as to be arranged in the circumferential direction of the casing 2. The plurality of stationary vanes 9 are disposed in a plurality of stages alternately with the rotor blade rows in the axial direction of the rotor 5, thereby forming stationary vane rows.

The casing outlet 2*b* of the steam turbine 1 may be in communication with a condenser (not depicted).

The gland seal portions 22*a*, 22*b* are provided to suppress leakage of steam from the casing interior space 3 to the casing exterior 4 via a gap between the casing 2 and the rotor 5, or entry of air from the casing exterior 4 to the casing interior space 3. The gland seal portions 22*a*, 22*b* are disposed on the first side (the side of the casing inlet 2*a*) and the second side (the side of the casing outlet 2*b*) of the casing 2 in the axial direction of the rotor 5, respectively. The gland seal portions 22*a*, 22*b* are disposed in gland cases 23*a*, 23*b* disposed between the rotor through hole of the casing 2 and the outer peripheral surface of the rotor 5, respectively. In the depicted example, the high-pressure side gland seal portion 22*a* is disposed on the high-pressure side (the side of the casing inlet 2*a*) of the casing interior space 3, and the low-pressure side gland seal portion 22*b* is disposed on the low-pressure side (the side of the casing outlet 2*b*) of the casing interior space 3.

In the steam turbine 1 having the above configuration, during normal operation, steam introduced into the casing interior space 3 from the casing inlet 2*a* flows through the casing interior space 3 while passing through the plurality of turbine blades (rotor blades 8 and stationary vanes 9) 10, and thereby a rotational force is generated on the rotor 5. Further, steam after having performed work is discharged to the outside from the casing interior space 3 through the casing outlet 2*b*.

At this time, the gland seal portions 22*a*, 22*b* are supplied with gland steam. Accordingly, it is possible to ensure the sealing performance of the gap between the casing 2 and the rotor 5, thereby suppressing leakage of steam from the casing interior space 3 to the casing exterior 4, or entry of air from the casing exterior 4 to the casing interior space 3.

Figure 2:
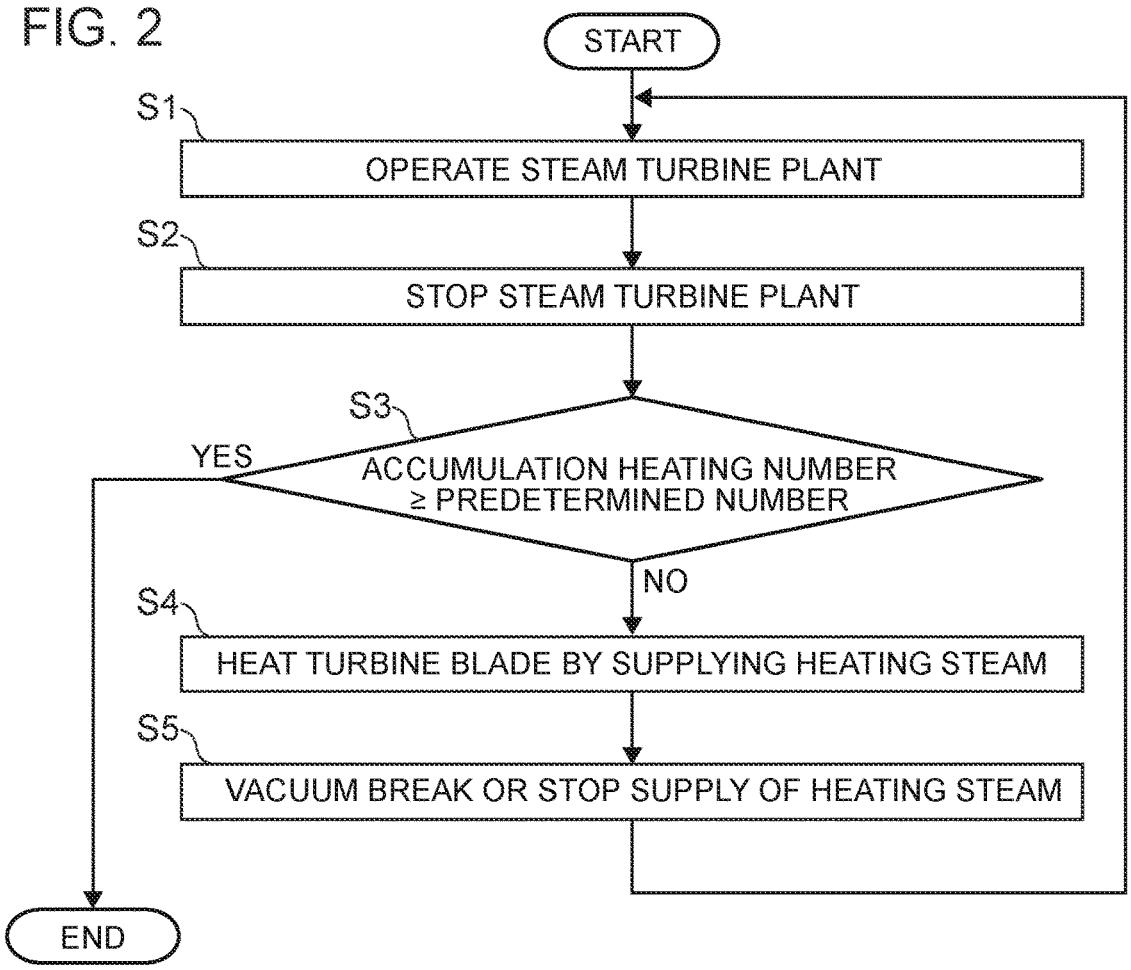
FIG. 2 is a flowchart of a dehydrogenation processing method for turbine blades according to an embodiment.

Next, with reference to FIG. 2, the dehydrogenation processing method for turbine blades according to some embodiments will be described. Herein, FIG. 2 is a flowchart of a dehydrogenation processing method for turbine blades according to an embodiment. In the following description, each component of the steam turbine 1 is indicated by the same reference numeral shown in FIG. 1.

In the embodiment shown in FIG. 2, shown is an exemplary embodiment where the turbine blades 10 are heated when the steam turbine 1 is stopped. Nevertheless, in another embodiment, the turbine blades 10 may be heated when the steam turbine 1 is started.

As shown in FIG. 2, the dehydrogenation processing method for turbine blades according to some embodiments includes a step (S4) of heating the turbine blades 10 by supplying heating steam into the casing 2 of the steam turbine 1 when the steam turbine 1 is stopped (S2) or started.

For instance, in the embodiment shown in FIG. 2, the steam turbine 1 is operated (S1), and then the steam turbine 1 is stopped (S2). After the steam turbine 1 is stopped, heating steam is supplied into the casing 2 of the steam turbine 1 to heat the turbine blades 10 (S4).

In the above method, heating steam supplied into the casing 2 of the steam turbine 1 may have a higher temperature than steam that passes through the turbine blades 10 during operation of the steam turbine 1 (working steam). More specifically, heating steam may have a higher temperature than working steam at a location to which the heating steal is supplied.

The heating steam to be supplied into the casing 2 of the steam turbine 1 is not particularly limited, and may be gland steam described below, or another steam generated in the plant in which the steam turbine 1 is installed. The other steam may be steam drawn from an auxiliary steam system of the plant, for instance, or steam extracted from a mid-pressure turbine or a high-pressure turbine.

Further, the heating time of the turbine blades 10, that is, duration of supply of heating steam into the casing 2, may be longer than that in a case where the dehydrogenation processing is not performed on the turbine blades 10. Specifically, the heating time of the turbine blades 10 may be set on the basis of at least one of the concentration of hydrogen contained in the turbine blades 10, the thickness of the turbine blades 10, the temperature of the heating steam, or the flow rate of the heating steam. For instance, the heating time of the turbine blades 10 may be not shorter than 12 hours and not longer than 24 hours.

During operation of the steam turbine 1, the steam turbine at each position inside the casing is substantially fixed. Thus, depending on position inside the casing 2, steam having a relatively low temperature acts on the turbine blades 10, and release of hydrogen from the turbine blades 10 can be barely expected during operation of the steam turbine 1.

According to the above method, heating steam is supplied into the casing 2 when the steam turbine 1 is started or stopped, and thus it is possible to use heating steam having a suitable temperature for dehydrogenation processing, unlike when the steam turbine 1 is in operation. Thus, also for the turbine blades 10 that hardly release hydrogen during operation of the steam turbine 1, it is possible to perform the dehydrogenation processing, by causing the turbine blades 10 to make contact with heating steam when the steam turbine 1 is started or stopped. In particular, the rotor blades 8 tend to occlude hydrogen at the time of manufacture, and thus it is possible to remove hydrogen effectively from the rotor blades 8 through the above method.

Accordingly, it is possible to suppress hydrogen embrittlement of the turbine blades 10, without performing complicated works such as removing the turbine blades 10.

Further, by using heating steam having a higher temperature than working steam, it is possible to raise the temperature of the turbine blades 10 more easily, and thus promote dehydrogenation of the turbine blades 10.

Figure 3:
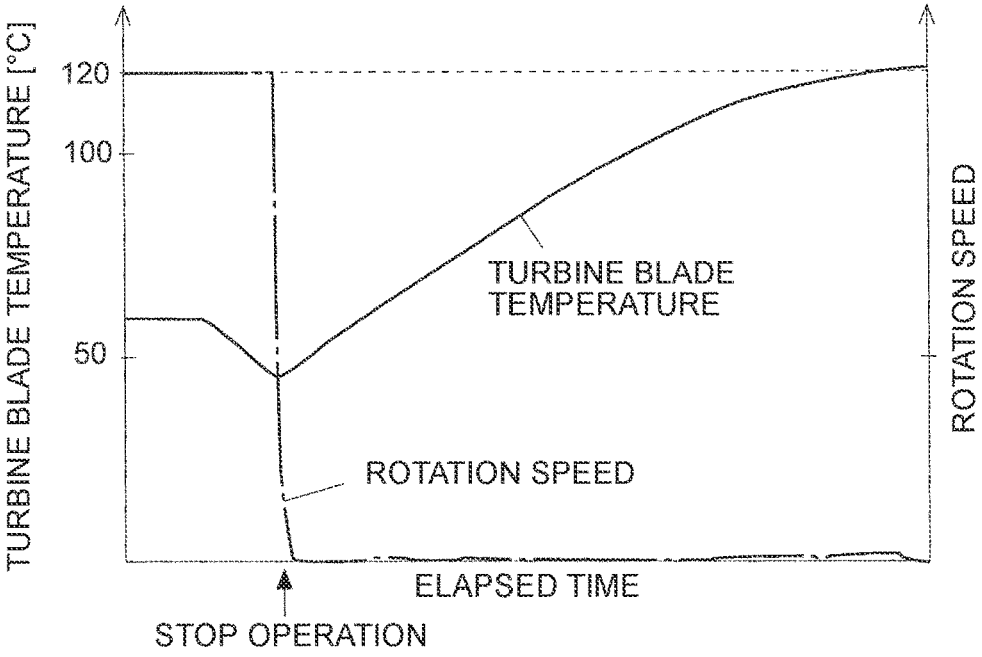
FIG. 3 is a graph showing an example of temporal change of the turbine blade temperature and the rotation speed of the steam turbine.
Figure 4:
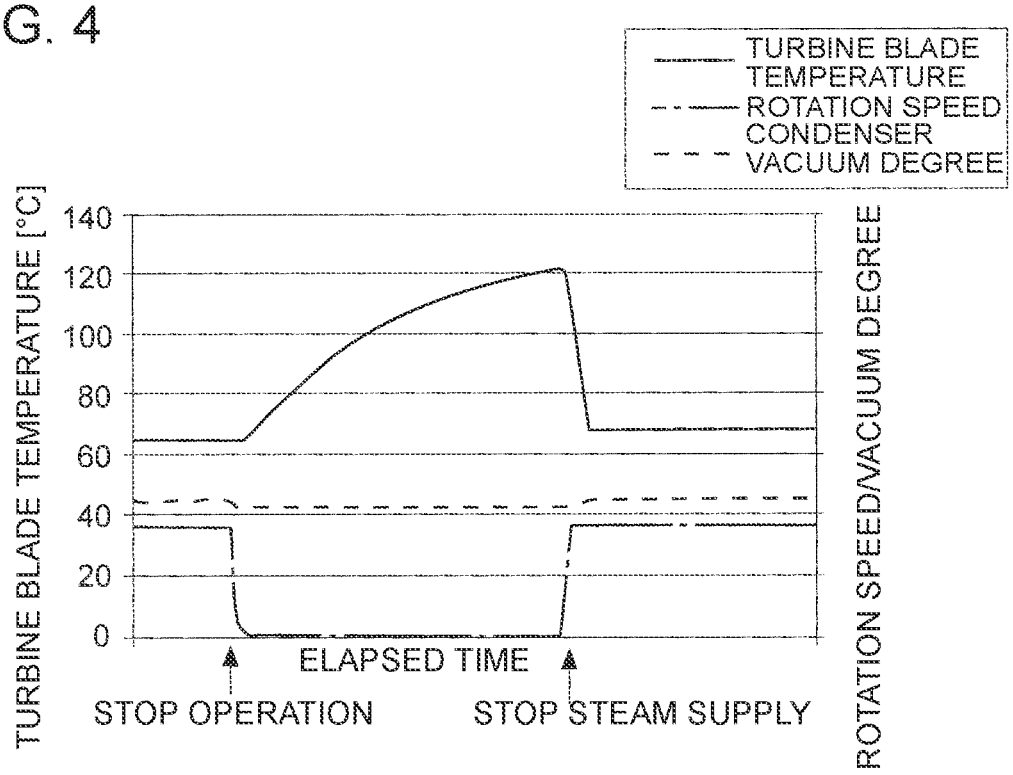
FIG. 4 is a graph showing the temporal change of the turbine blade temperature, the rotation speed of the steam turbine, the casing vacuum degree (if supply of heating steam is stopped), according to an embodiment.
Figure 5:
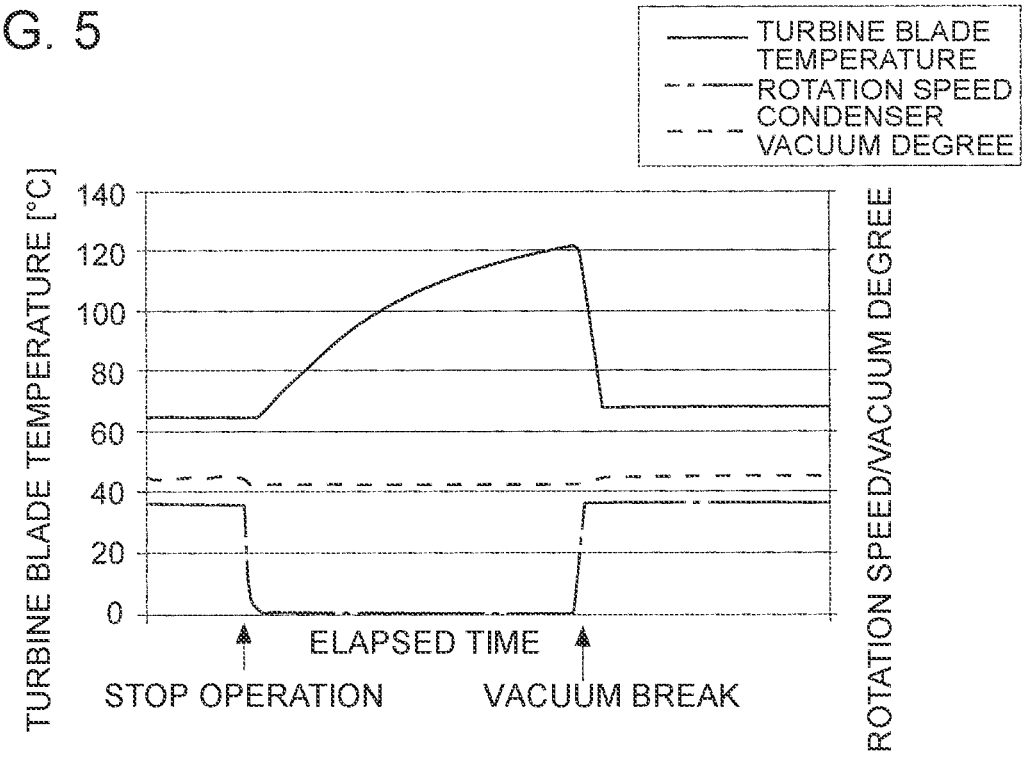
FIG. 5 is a graph showing the temporal change of the turbine blade temperature, the rotation speed of the steam turbine, the casing vacuum degree (if vacuum break is performed), according to another embodiment.

In an embodiment, in the step of heating the turbine blades 10 as shown in FIG. 2 (S4), the turbine blades 10 may be heated to a temperature of 120° C. or higher (see FIGS. 3 to 5).

For instance, as shown in FIG. 3, when supply of steam to the steam turbine 1 is stopped, the rotation speed of the steam turbine 1 decreases rapidly. Then, when heating steam is supplied to the casing 2, the turbine blade temperature gradually increases with time after stop. Herein, FIG. 3 is a graph showing an example of temporal change of the turbine blade temperature and the rotation speed of the steam turbine.

As a result of intensive researches by the present inventors, it was found that the hydrogen content in the turbine blades 10 decreases significantly by heating the turbine blades 10 to a temperature of 120° C. or higher.

Thus, according to the above method, it is possible to perform dehydrogenation processing on the turbine blades 10 effectively by increasing the temperature of the turbine blades 10 to 120° C. or higher.

Furthermore, in view of the heat resistance property of the turbine blades 10 and other components of the casing, the heating steam may be supplied so that the temperature of the turbine blades 10 does not exceed 180° C.

In the step of heating the turbine blades 10 (S4), the process of supplying heating steam into the casing 2 may be repeated multiple times.

In this case, the process of supplying heating steam into the casing 2 may be repeated until the accumulation execution number of the heating process (S4) of the turbine blades 10 reaches a predetermined number.

For instance, in the embodiment shown in FIG. 2, after stopping operation of the steam turbine 1 (S2), it is determined whether the accumulation execution number of the heating process (S4) of the turbine blades 10 after the initial state of the steam turbine 1 is not smaller than a predetermined number (S3). If the accumulation execution number of the heating process for the turbine blades 10 is not smaller than a predetermined number, the heating process for the turbine blades 10 (S4) is not performed. On the other hand, if the accumulation execution number of the heating process for the turbine blades 10 is smaller than a predetermined number, the heating process for the turbine blades 10 (S4) is performed by supplying heating steam into the casing 2. Further, after the elapse of a setting time from heating of the turbine blades 10, vacuum break is performed, or supply of heating steam is stopped (S5).

Then, operation of the steam turbine 1 is restarted when needed (S1), and when the steam turbine 1 is to be stopped (S2), it is determined again whether the accumulation execution number of the heating process for the turbine blades 10 is not smaller than the predetermined number (S3). The above steps are repeated until the accumulation execution number of the heating process for the turbine blades 10 reaches the predetermined number.

Herein, "predetermined number" is typically two or more, and may be set individually depending on the type of the steam turbine, the gland steam temperature, and the like.

FIG. 4 is a graph showing the temporal change of the turbine blade temperature, the rotation speed of the steam turbine, the casing vacuum degree (if supply of heating steam is stopped), according to an embodiment. FIG. 5 is a graph showing the temporal change of the turbine blade temperature, the rotation speed of the steam turbine, the casing vacuum degree (if supply of heating steam is stopped), according to another embodiment.

In the embodiment shown in FIG. 4, after operation of the steam turbine 1 is stopped, heating steam is supplied into the casing 2, and the supply of heating steam is stopped after a predetermined period of time. By supplying heating steam into the casing 2, the turbine blade temperature increases gradually, and once the supply of heating steam is stopped, the turbine blade temperature decreases.

In the embodiment shown in FIG. 5, after operation of the steam turbine 1 is stopped, heating steam is supplied into the casing 2, and vacuum break is performed after a predetermined period of time. By supplying heating steam into the casing 2, the turbine blade temperature increases gradually, and after the vacuum break, the turbine blade temperature decreases. In this case, the supply of heating steam may be stopped after vacuum break.

Herein, vacuum break refers to, in a case where a condenser (not depicted) is disposed in a latter stage of the steam turbine 1, opening a vacuum break valve of the condenser to bring the pressure inside the casing 2 closer to the atmospheric pressure.

As a result of intensive researches by the present inventors, it was found that the hydrogen content in the turbine blades 10 decreases considerably by repeating the heating process for the turbine blades 10 multiple times.

Figure 6:
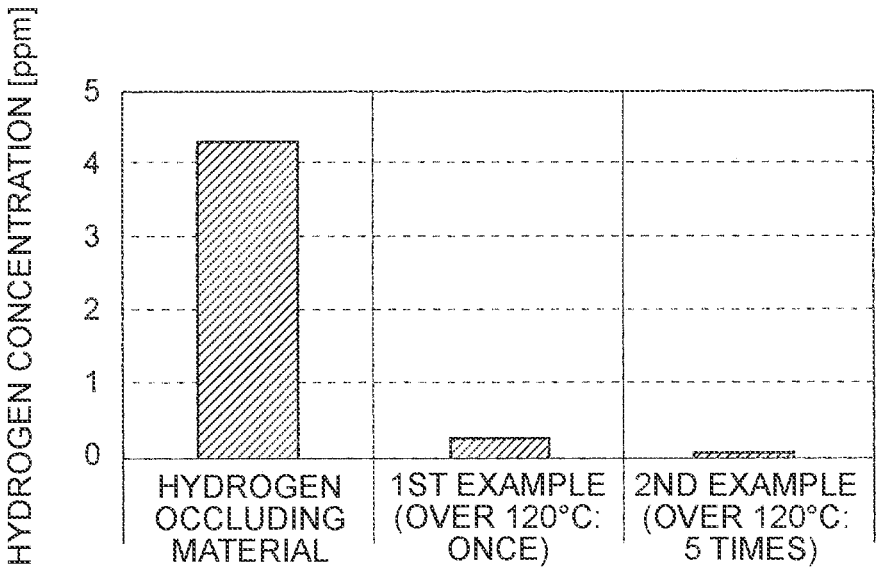
FIG. 6 is a graph showing a result of an evaluation test of a dehydrogenation effect on turbine blades.

Herein, FIG. 6 shows a result of an evaluation test of the dehydrogenation effect achieved by the above described heating process on the turbine blades 10. FIG. 6 shows a hydrogen concentration at the time when stainless steel occluding 4.3 ppm hydrogen is heated to a temperature higher than 120° C. As shown in the graph, the hydrogen concentration decreases to 0.24 ppm when the heating process is performed once, and to 0.03 ppm when the heating process is repeated five times.

According to the above method, it is possible to perform the dehydrogenation processing on the turbine blades 10 effectively by repeating the heating process for the turbine blades multiple times.

Further, it is possible to perform the dehydrogenation processing for the turbine blades 10 effectively, by repeating the heating process until the accumulation execution number of the heating process for the turbine blades 10 reaches a predetermined number.

Further, the heating process may be less frequent if the turbine blades 10 have a low hydrogen concentration in the initial state or if the turbine blades 10 have a relatively small thickness.

In the above method, the turbine blades 10 to be heated may include final stage blades of the low-pressure steam turbine (e.g. final stage rotor blades 8*a* depicted in FIG. 1).

During operation of the steam turbine 1, steam having a low temperature such as about 50° C. acts on the final stage blades of the low-pressure steam turbine. Thus, release of hydrogen from the turbine blades 10 can be barely expected during operation of the steam turbine 1.

In this regard, according to the above method, as described above, it is possible to suppress hydrogen embrittlement of the final stage blades of the low-pressure steam turbine, without performing complicated works such as removing the turbine blades 10, by supplying heating steam into the casing 2 when the steam turbine 1 is started or stopped.

In the above method, the turbine blades 10 may be martensitic stainless steel. For instance, martensitic stainless steel includes, for instance, Ph13-8Mo steel, 17-4PH steel, and 12cr steel.

According to findings of the present inventors, martensitic stainless steel used to make the turbine blades 10 tends to become brittle when the hydrogen content increases.

In this regard, as described above, it is possible to prevent damage due to hydrogen embrittlement of the turbine blades 10 made of martensitic stainless steel, without performing complicated works such as removing the turbine blades 10, by supplying heating steam into the casing when the steam turbine 1 is started or stopped.

Figure 7:
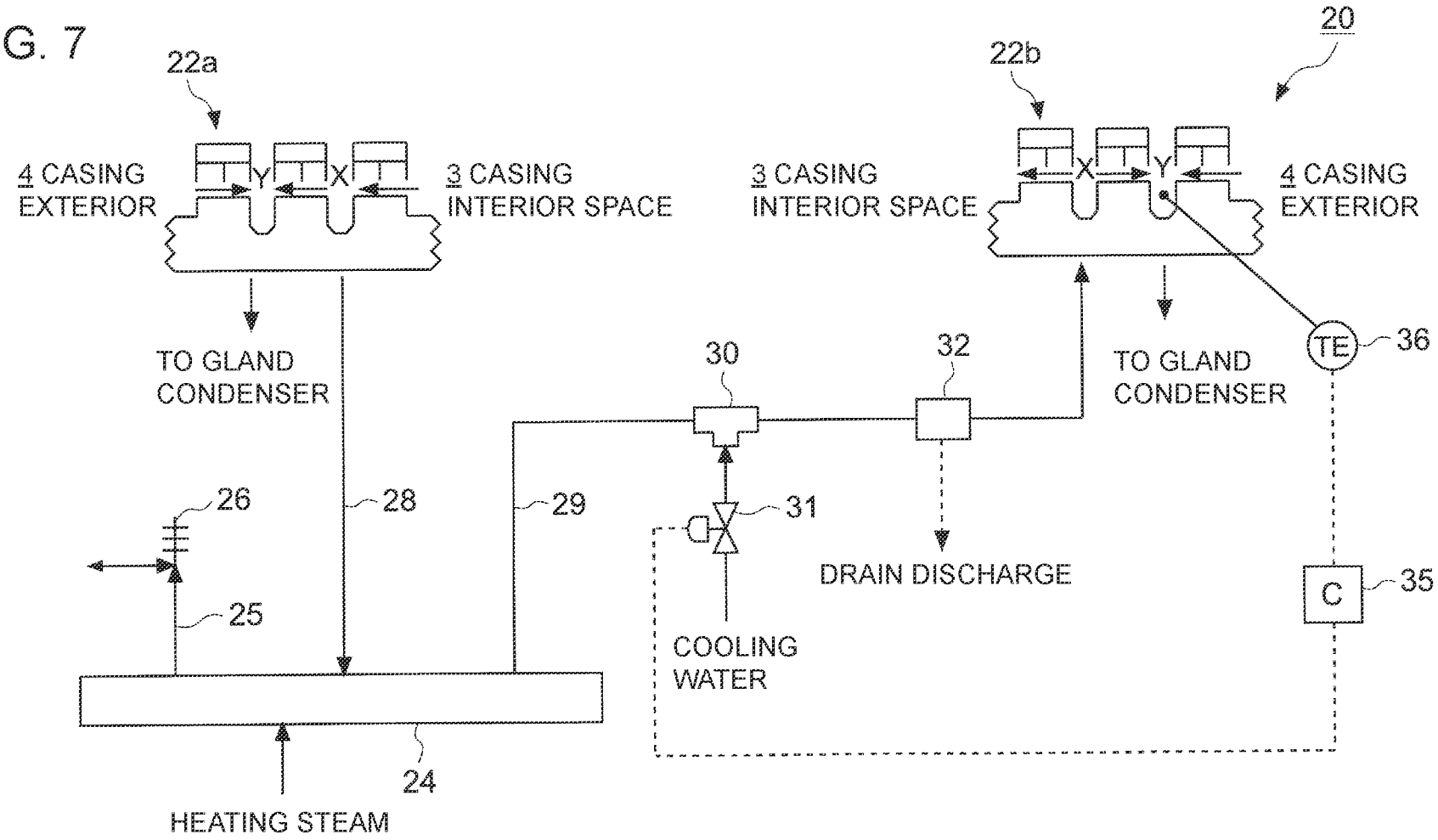
FIG. 7 is a schematic configuration diagram of a gland system (in high-load operation) according to an embodiment.
Figure 8:
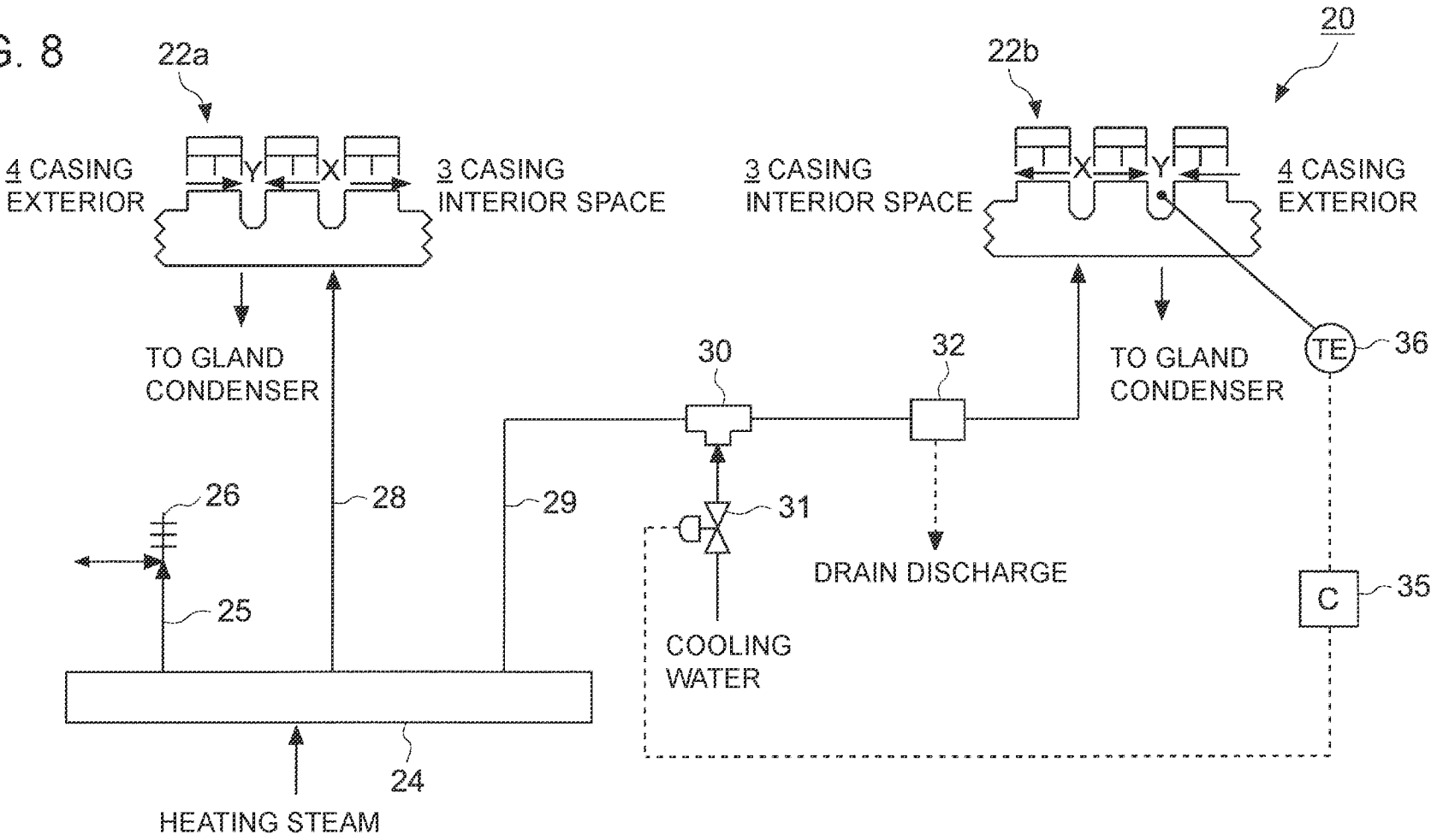
FIG. 8 is a schematic configuration diagram of a gland system (when heating turbine blades) according to an embodiment.

In the above described step of heating the turbine blades 10 (S4), as shown in FIGS. 7 and 8, gland steam may be supplied into the casing 2 as heating steam, via the gland seal portions 22*a*, 22*b* of the steam turbine 1.

Next, with reference to FIGS. 7 and 8, a specific configuration example of a gland system 20 will be described. FIG. 7 is a schematic configuration diagram of a gland system (in high-load operation) 20 according to an embodiment. FIG. 8 is a schematic configuration diagram of a gland system (when heating turbine blades) 20 according to an embodiment.

In the following description, each component of the steam turbine 1 is described with the same reference numeral shown in FIG. 1, where appropriate.

As shown in FIGS. 7 and 8 as an example, the gland system 20 according to some embodiments includes the above described gland seal portions 22*a*, 22*b*, a gland steam header 24 for storing gland steam to be supplied to the gland seal portions 22*a*, 22*b*, and gland steam lines 28, 29 disposed between the gland steam header 24 and the gland seal portions 22*a*, 22*b*.

In the present embodiment, gland steam refers to steam that flows through the gland seal portions 22*a*, 22*b* and thereby functions to ensure the sealing performance between the casing interior space 3 and the casing exterior 4. That is, gland steam includes steam that flows from the casing interior space 3 to the casing exterior 4 via the gland seal portions 22*a*, 22*b*, respectively.

The gland steam header 24 is configured to store gland steam to be supplied to the gland seal portions 22*a*, 22*b*. For instance, the gland steam stored in the gland steam header 24 may be steam drawn from an auxiliary steam system of the plant, steam extracted from e.g. the mid-pressure turbine or the high-pressure turbine, or steam obtained by depressurizing turbine-inlet steam. Further, gland steam may contain steam recovered from the high-pressure side gland seal portion 22*a* at a high-load time. Moreover, gland steam may include combination of more than one types of steam from different sources as described above.

As shown in FIG. 7, during high-load operation of the steam turbine 1, the casing interior pressure is relatively high, and thus steam (gland steam) flows out from the casing interior space 3 toward the casing exterior 4 at the high-pressure side gland seal portion 22*a*. At least a part of the gland steam is recovered by the gland steam header 24 via the gland steam line 28. Further, at least another part of the gland steam may be guided to a gland condenser to be condensed. For instance, a part of the flown-out gland steam is recovered by the gland steam header 24 from the casing-side portion X of the high-pressure side gland seal portion 22*a*, and the remainder of the flown-out gland steam is guided to the gland condenser from the atmosphere-side portion Y.

Furthermore, the low-pressure side gland seal portion 22*b* is supplied with gland steam from the gland steam header 24. Further, at least another part of the gland steam flowing out from the low-pressure side gland seal portion 22*b* may be guided to a gland condenser. For instance, the gland steam is supplied to the casing-side portion X of the low-pressure side gland seal portion 22*b* from the gland steam header 24, and a part of the supplied gland steam (containing air) is guided to the gland condenser from the atmosphere-side portion Y of the low-pressure side gland seal portion 22*b*.

Furthermore, during low-load operation or no-load operation of the steam turbine 1, the high-pressure side gland seal portion 22*a* is also supplied with gland steam from the gland steam header 24.

As shown in FIG. 8, in the heating process for the turbine blades 10, the gland steam from the gland steam header 24 is supplied to the gland seal portions 22*a*, 22*b* via the gland steam lines 28, 29. At this time, the casing interior pressure is relatively low, and thus the gland steam is supplied into the casing 2 via the gland seal portions 22*a*, 22*b*. For instance, gland steam is supplied from the gland steam header 24 to the casing-side portion X of the high-pressure side gland seal portion 22*a* and the casing-side portion X of the low-pressure side gland seal portion 22*b*. Furthermore, a part of the supplied gland steam (containing air) is guided to the gland condenser from the atmosphere-side portion Y of the high-pressure side gland seal portion 22*a* and the atmosphere-side portion Y of the low-pressure side gland seal portion 22*b*.

According to this method, by utilizing the gland seal portions 22*a*, 22*b* and the gland steam system (gland steam header 24, gland steam lines 28, 29, etc.), which are provided for a typical steam turbine facility, it is possible to introduce gland steam (heating steam) into the casing 2 readily via the gland seal portions 22*a*, 22*b*, when the steam turbine 1 is started or stopped and the pressure of the casing 2 decreases. Thus, it is possible to perform the dehydrogenation processing for the turbine blades 10 without providing special equipment to supply heating steam into the casing 2.

As shown in FIGS. 7 and 8, a discharge line 25 having a relief valve 26 may be connected to the gland steam header 24, to prevent an excessive pressure increase inside the gland steam header 24. In this case, if the pressure in the gland steam header 24 exceeds a setting value, the relief valve 26 opens and discharges gland steam from the discharge line 25.

In the above method, in the heating process for the turbine blades 10, the temperature of gland steam may be set to be higher than that during operation of the steam turbine 1. That is, the temperature of gland steam used in the heating process for the turbine blades 10 is set to be higher than the temperature of steam supplied to the gland seal portions 22*a*, 22*b* during operation of the steam turbine 1. For instance, steam supplied to the gland steam header 24 may have a higher temperature than that during operation of the steam turbine 1, or the gland steam may be heated between the gland steam header 24 and the gland seal portions 22*a*, 22*b* when being supplied, as described below.

Accordingly, by setting the temperature of gland steam to be higher than that in operation of the steam turbine 1, it is possible to heat the turbine blades 10 to an even higher temperature, and thereby to perform the dehydrogenation processing for the turbine blades 10 effectively.

Further, the temperature of the gland steam may be adjusted by a temperature adjuster disposed in the gland steam line 29 for supplying gland steam to the gland seal portions 22*a*, 22*b*.

In this case, as shown in FIG. 8, the temperature adjuster may be a desuperheater 30 disposed in the gland steam line 29 between the gland steam header 24 and the gland seal portions 22*a*, 22*b*, and the temperature decrease amount of the gland steam may be adjusted by the desuperheater 30. For instance, the desuperheater 30 may cool the gland steam by performing indirect heat exchange with cooling water. In this case, the temperature of the turbine blades 10 may be detected by the temperature sensor 36, and the opening degree of a flow-rate adjustment valve 31 may be controlled by a control device 35 on the basis of the temperature, to adjust the flow rate of cooling water for cooling the gland steam.

In another non-depicted embodiment, the temperature adjuster may be a heater for heating the gland steam.

Accordingly, by adjusting the temperature of gland steam to be supplied to the gland seal portions 22*a*, 22*b* with the temperature adjuster disposed in the gland steam line 29, it is possible to control the temperature of the turbine blades 10 during the dehydrogenation processing, and perform dehydrogenation processing effectively. Furthermore, it is possible to suppress an excessive increase in the temperature of the gland steam, and prevent operation of the interlock related to the gland steam temperature, for instance.

Further, by using the desuperheater 30 as the temperature adjuster, it is possible to adjust the temperature of gland steam flowing toward the gland seal portions 22*a*, 22*b* from the gland steam header appropriately with the desuperheater 30, and thereby it is possible to promote dehydrogenation processing and prevent operation of interlock related to the gland steam temperature at the same time.

In the above method, in the heating process for the turbine blades 10, the temperature setting value for gland steam in the desuperheater 30 may be higher than that during operation of the steam turbine 1.

Accordingly, by setting the temperature setting value of gland steam in the desuperheater 30 to be higher than that in operation of the steam turbine 1, it is possible to heat the turbine blades 10 to an even higher temperature, and thereby to perform the dehydrogenation processing effectively.

As shown in FIG. 8, a drain separator 32 may be disposed in the gland steam line 29, on the side closer to the low-pressure side gland seal portion 22*b* than the desuperheater 30.

The drain separator 32 is configured to separate drain generated from condensation of a part of gland steam in the desuperheater 30.

Accordingly, by separating drain generated from condensation of a part of gland steam in the desuperheater 30 with the drain separator 32, it is possible to prevent entry of drain to the casing 2.

In the embodiment shown in FIGS. 7 and 8, the desuperheater 30 and the drain separator 32 are disposed only in the gland steam line 29 for supplying gland steam to the low-pressure side gland seal portion 22*b*. Nevertheless, the desuperheater 30 and the drain separator 32 may be disposed also in the gland steam line 28 for supplying gland steam to the high-pressure side gland seal portion 22*a*.

Further, in the above method, gland steam may be supplied to the gland seal portions 22*a*, 22*b* while maintaining the pressure inside the casing 2 to be less than the atmospheric pressure, so as to let gland steam flow into the casing 2 and increase the pressure inside the casing 2 to the atmospheric pressure after heating the turbine blades 10, or stop supply of gland steam to the gland seal portions 22*a*, 22*b* (see FIG. 5).

According to this method, it is possible to introduce gland steam easily into the casing 2 by supplying gland steam to the gland seal portions 22*a*, 22*b* while maintaining the pressure in the casing 2 to be less than the atmospheric pressure. Thus, it is possible to fill the casing 2 with high-temperature gland steam, and heat the turbine blades 10 effectively with the gland steam.

As described above, according to at least some embodiments of the present invention, also for the turbine blades 10 that hardly release hydrogen during operation of the steam turbine 1, it is possible to perform the dehydrogenation processing, by causing the turbine blades 10 to make contact with heating steam when the steam turbine 1 is started or stopped. Accordingly, it is possible to suppress hydrogen embrittlement of the turbine blades 10, without performing complicated works such as removing the turbine blades 10.

Embodiments of the present invention were described in detail above, but the present invention is not limited thereto, and various amendments and modifications may be implemented.

For instance, while a single-flow steam turbine is depicted in FIG. 1, where working steam enters from the casing inlet 2*a* and then flows in a single direction (in the drawing, from left to right), the above description of the embodiments can be also applied to a double-flow steam turbine, where working steam enters from a casing inlet and flows in both directions.

For instance, an expression of an equal state such as "same" "equal" and "uniform" shall not be construed as indicating only the state in which the feature is strictly equal, but also includes a state in which there is a tolerance or a difference that can still achieve the same function.

On the other hand, an expression such as "comprise", "include", "have", "contain" and "constitute" are not intended to be exclusive of other components.

REFERENCE SIGNS LIST

1 Steam turbine
2 Casing
5 Rotor

8 Rotor blade
9 Stationary vane
10 Turbine blade
20 Gland system
22*a* High-pressure side gland seal portion
22*b* Low-pressure side gland seal portion
23*a*, 23*b* Gland case
24 Gland steam header
28, 29 Gland steam line
30 Desuperheater
31 Flow-rate adjustment valve
32 Drain separator

The invention claimed is:

1. A dehydrogenation processing method for a turbine blade of a steam turbine, the method comprising:

a step of heating the turbine blade by supplying heating steam into a casing of the steam turbine after a steam turbine plant is stopped, wherein the heating steam has a higher temperature than steam passing through the turbine blade during operation of the steam turbine plant, and repeating the process of supplying the heating steam into the casing of the steam turbine, wherein the process of supplying the heating steam into the casing is repeated multiple times.

2. The dehydrogenation processing method for a turbine blade according to claim 1, wherein the step of heating the turbine blade includes supplying gland steam as the heating steam into the casing via a gland seal portion of the steam turbine.

3. The dehydrogenation processing method for a turbine blade according to claim 2, wherein the step of heating the turbine blade includes setting the temperature of the gland steam as the heating steam to be higher than gland steam during operation of the steam turbine plant.

4. The dehydrogenation processing method for a turbine blade according to claim 3, wherein the temperature of the gland steam is adjusted by a temperature adjuster disposed in a gland steam line for supplying the gland steam to the gland seal portion.

5. The dehydrogenation processing method for a turbine blade according to claim 4, wherein the temperature adjuster is a desuperheater disposed in the gland steam line between a gland steam header and the gland seal portion, and wherein the desuperheater is configured to adjust a temperature decrease amount of the gland steam.

6. The dehydrogenation processing method for a turbine blade according to claim 5, wherein the step of heating the turbine blade includes increasing a temperature setting value of the gland steam at the desuperheater compared to during operation of the steam turbine plant.

7. The dehydrogenation processing method for a turbine blade according to claim 2, further comprising:

introducing the gland steam into the casing by supplying the gland steam into the gland seal portion while maintaining a pressure inside the casing to be less than an atmospheric pressure; and after heating the turbine blade, increasing the pressure inside the casing to the atmospheric pressure, or stopping supply of the gland steam to the gland seal portion.

8. The dehydrogenation processing method for a turbine blade according to claim 1, wherein the step of heating the turbine blade includes heating the turbine blade to a temperature of 120° C. or higher.

9. The dehydrogenation processing method for a turbine blade according to claim 1, further comprising:

repeating the process of supplying the heating steam into the casing for multiple times when the steam turbine plant is stopped, until an accumulated execution number of the process reaches a predetermined number.

10. The dehydrogenation processing method for a turbine blade according to claim 1, wherein the turbine blade to be heated includes a final stage blade of a low-pressure steam turbine.

11. The dehydrogenation processing method for a turbine blade according to claim 1, wherein the turbine blade is made of martensitic stainless steel.

* * * * *